United States Patent [19]

Matt et al.

[11] 4,441,888

[45] Apr. 10, 1984

[54] COAL-WATER SLURRY VISCOSITY REDUCTION USING OLEFIN/MALEIC ACID SALT COPOLYMERS

[75] Inventors: Joseph Matt, Downers Grove; John M. Ferrara, Palos Heights, both of Ill.

[73] Assignee: Nalco Chemical Company, Oak Brook, Ill.

[21] Appl. No.: 380,488

[22] Filed: May 21, 1982

[51] Int. Cl.[3] ..... C10L 1/32

[52] U.S. Cl. ..... 44/51; 44/62; 252/356

[58] Field of Search ..... 44/51, 62; 252/356

[56] References Cited

U.S. PATENT DOCUMENTS

| | | | |
|---|---|---|---|
| 2,615,845 | 10/1952 | Lippincott et al. | 44/62 |
| 4,242,098 | 12/1980 | Braun et al. | 44/62 |
| 4,282,006 | 8/1981 | Funk | 44/51 |
| 4,302,212 | 11/1981 | Yamamura | 44/51 |

FOREIGN PATENT DOCUMENTS

| | | | |
|---|---|---|---|
| 55-56189 | 4/1980 | Japan | 44/51 |
| 56-57891 | 5/1981 | Japan | 44/62 |

OTHER PUBLICATIONS

Steffers et al., Chemical Abstracts, vol. 91, No. 91:108877j, 1979.

*Primary Examiner*—Charles F. Warren
*Assistant Examiner*—Margaret B. Medley
*Attorney, Agent, or Firm*—John G. Premo; Robert A. Miller; Donald G. Epple

[57] ABSTRACT

An improved coal-water slurry of the type comprising at least 45% by weight of finely divided coal particles and a dispersing agent, said slurry being characterized as having a Brookfield viscosity at 60 rpm of less than 4,000 centipoise, the improvement which comprises adjusting the pH of said slurry to at least 6 and using as the dispersing agent, a water-soluble salt of an olefin/-maleic acid copolymer having a molecular weight within the range of about between 3,000–50,000.

4 Claims, 2 Drawing Figures

COAL-WATER SLURRY VISCOSITY REDUCTION USING OLEFIN/MALEIC ACID SALT COPOLYMERS

INTRODUCTION

Figure 1:
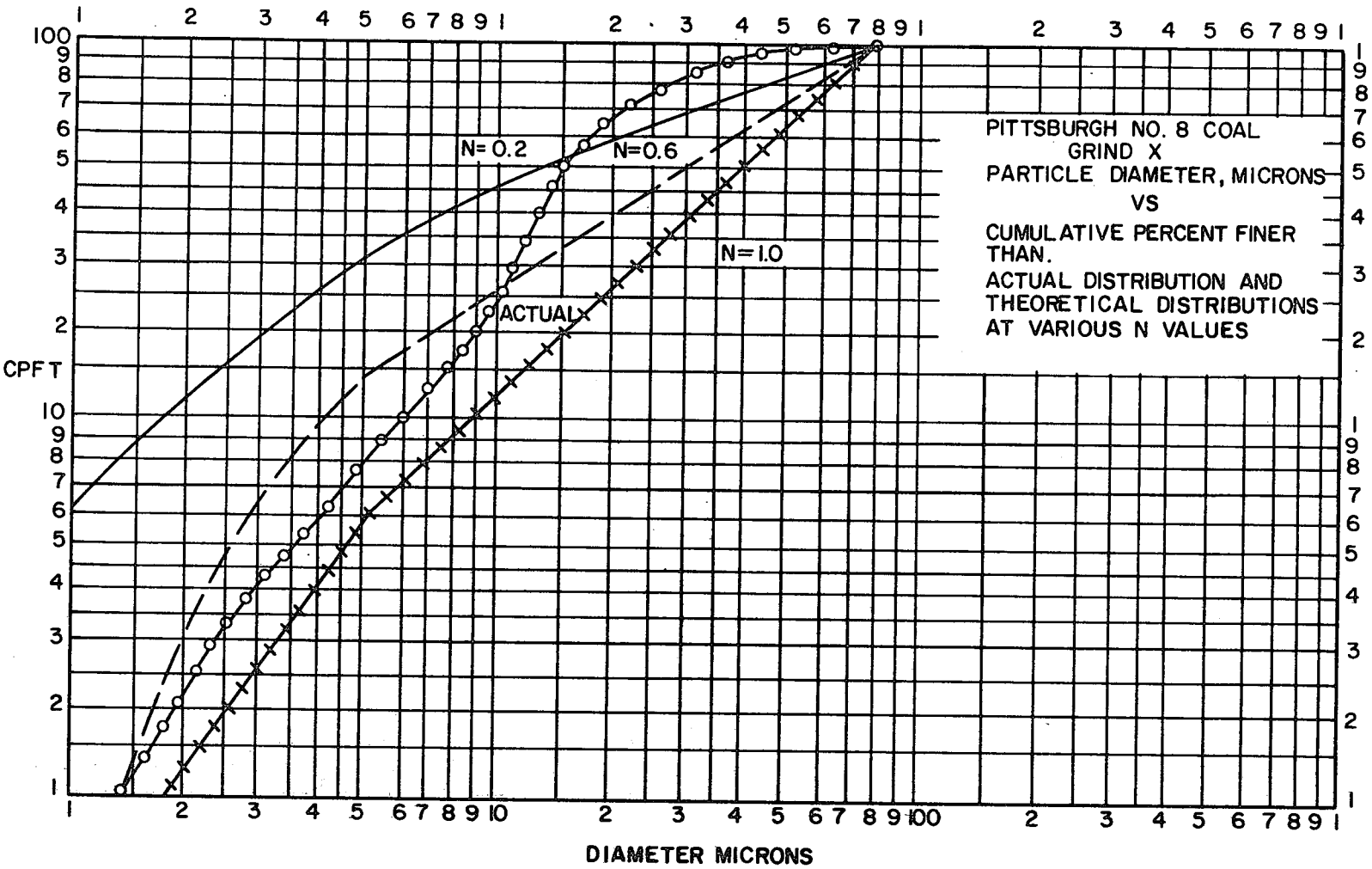

U.S. Pat. No. 4,282,006 discloses pipeline pumped high-solids content coal-water slurries. These slurries may be generically characterized as having a Brookfield viscosity of about 2000 cps or less at 60 rpm at about 75 weight percent, dry basis, coal content. These slurries, because of their high coal content, are capable of being directly burned in a furnace. Prior art coal-water slurries having a lower coal content must first be subjected to a dewatering step prior to being utilized as a fuel. The slurries described in U.S. Pat. No. 4,282,006 are fluid and pumpable because of several factors. The primary factor contributing to high solid content and fluidity is the particle size distribution of these slurries. The other factor is the type and amount of dispersing agent and/or electrolyte used in the preparation of these slurries.

The particle size distribution of the coal slurries set forth in U.S. Pat. No. 4,282,006 corresponds to a formula set forth in the patent. This formula is known as the Alfred formula. When plotted in the form of a graph, the particle size distribution is basically a straight line. One of the discoveries of the present invention is that slurries other than, as well as those described in U.S. Pat. No. 4,282,006 may be prepared as pumpable high solid coal concentrates. These concentrates, when their particle size distribution is plotted as a graph, do not appear to fall within the non-undulating particle distributions taught in the U.S. Pat. No. 4,282,006.

The goal of this invention is to obtain high concentrated coal-water slurries which are pumpable and which, when stored for reasonable length of time, can easily be redispersed and pumpable without substantial settling losses.

The present invention contemplates utilizing an improved surfactant to prepare concentrated coal-water slurries. These slurries may be of the type described in U.S. Pat. No. 4,282,006, as well as other similar slurries which contain a different particle size distribution from that described in U.S. Pat. No. 4,282,006.

Though detailed analysis of particle size is not present, aqueous coal slurries using various dispersing agents are also taught in U.S. Pat. No. 4,242,098 and U.S. Pat. No. 4,302,212.

THE INVENTION

An improved coal-water slurry of the type comprising at least 45% by weight of finely divided coal particles and a dispersing agent, said slurry being characterized as having a Brookfield viscosity at 60 rpm of less than 4000 centipoise, the improvement which comprises adjusting the pH of said slurry to at least 6 and using as the dispersing agent, a water-soluble salt of an olefin/-maleic acid copolymer having a 50,000 molecular weight within the range of about between 3,000–50,000. Molecular weights in this patent are the peak maximum molecular weights as determined by gel-phase chromatography.

This invention is particularly adapted to providing improved Alfred formula coal-water slurries.

The Water-Soluble Salts of the Olefin/Maleic Acid Copolymers

These copolymers are prepared by reacting maleic acid and, most preferably, maleic anhydride with a low molecular weight aliphatic olefin such as pentene, butylene, hexene, diisobutylene, and the like. Preferably, the olefin should contain at least 3 and, preferably, not more than 12 carbon atoms. The preferred olefins are pentene and diisobutylene.

These copolymers are of a molecular weight range between 3,000–50,000 with a preferred range being about 4,000–16,000.

The polymers are used in a water-soluble form such as their salt form, e.g., alkali metal, ammonia, or amine salt form. The sodium salts are preferred.

Two materials useful in the invention are a pentene sodium maleate copolymer having a peak maximum molecular weight of about 6,000, (Copolymer A) and a diisobutylene sodium maleate copolymer which has a molecular weight maximum of about 14,000 (Copolymer B).

pH of the Slurry

The dispersants used in the practice of the invention provide low viscosity slurries when the pH of the slurry has been adjusted to at least 6 and, preferably, the pH is adjusted to 7 or more. Usually pH adjustment need not exceed 9.5 to obtain the advantages of the invention.

Dosage of the Dispersing Agent

The amount of dispersing agent used in the practice of the invention will range up to about 4% by weight based on the total weight of dry coal. Preferably the dosage will be within the range of 0.01 to 4% by weight. A preferred dosage is 0.05 to 2% by weight.

Particle Size Distribution

As indicated previously, the invention may utilize as a coal-water slurry a slurry which has coal particles distributed in accordance with the formula set forth in U.S. Pat. No. 4,282,006.

This formula is as follows:

$$CPFT = \left( \frac{D_\mu{}^n - D_s{}^n}{D_L{}^n - D_S{}^n} \right) \cdot 100,$$

where

CPFT=cumulative weight percent, dry basis, of particles finer than a particle $\mu$ of stated size, $D_\mu$=diameter of particle $\mu$, $D_L$=diameter of largest particle in compact, sieve size or its equivalent, $D_S$=diameter of smallest particle in compact, SEM size or its equivalent, n=numerical exponent, with n being in the range of 0.2 to 1.0, and with all diameters sized in $\mu$m, The particle size distribution of the coal particles according to the above formula for CPFT provides a non-undulating size distribution of particles which permits closer packing of more particles of coal in a specific volume of space in the compact than can be achieved with a particle size distribution which has undulating distribution of particles. Also, sizes of $D_L$ and $D_S$ have important effects on the suitability of the particle size distribution for use in the coal-water slurry. When $D_L$ is too large, large particles can settle out and cause pumping problems. When $D_S$ is too large and less than about 5 weight percent, dry basis, of particles of colloidal size that are present in the coal compact, the stability of the yield stress and the rheological properties of the coal-water slurry are adversely affected and the slurry may segregate or become dilatent or otherwise not pumpable. The value of the numerical exponent n in the formula CPFT is affected by the values of $D_L$ and $D_S$. While n will usually range from 0.2 to 1.0, n preferably will be in the range from about 0.2 to 0.7. $D_L$ usually will be in the range from 1180 μm to 38 μm and will preferably be in the range of 70 μm (micrometer or micron) to 600 μm, and most preferably will be about 300 μm. $D_S$ will be less than 3 μm (<3 μm) and usually will be in the range of 0.05 μm to 0.3 μm, and preferably will be about 0.1 μm.

The above formula is the Alfred formula.

While the Alfred formula represents one type of particle size distribution of finely divided coal that may be used to prepare the slurries of the invention, it will be understood others may be used without departing from the scope hereof.

It will be understood that the present invention has applicability to producing coal slurries from grinds having particle size distributions somewhat similar to the Alfred coal-water slurries although particle size distribution may vary from the limits set forth in U.S. Pat. No. 4,282,006.

Figure 2:
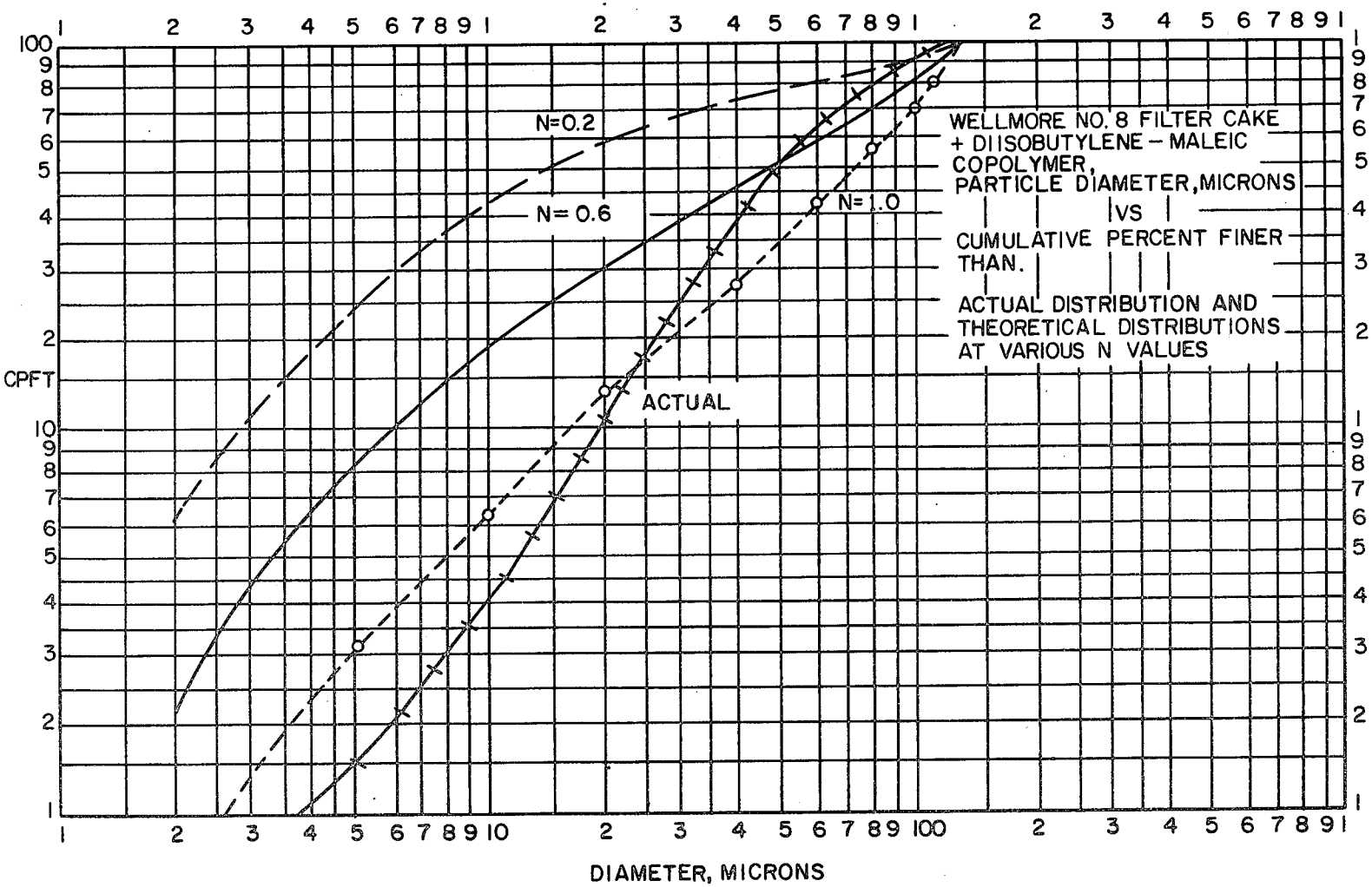

FIGS. 1 and 2 illustrate how the experimental grinds, demonstrated later in this application, relate to the theoretical curves generated using the "Alfred formula" while varying "n" values.

Such grinds are illustrated in Tables 1, 2, and 3, which follow. Tables 1 and 3 contain data which are generated using a technique for measuring particle size distribution that requires that a suspension of particles in an electrolyte solution be drawn through an orifice which also passes an electrical current. Each particle, in traversing the orifice, causes a momentary resistant charge which is proportional to the particle volume. This resultant sequence of electrical particle pulses is amplified, scaled, and counted, or otherwise electrically processed, to yield particle count and size distribution data.

The pulse amplitude is, in fact, proportional to the envelope volume of a particle as sensed by the electrical field which is shaped around its effective surface. For our purposes, this data will be referred to as having been generated using the particle data method.

Table 2 contains data on particle size distribution which is determined by yet another technique. This technique uses an instrument known as the Microtrac Particle Size Analyzer, manufactured by Leeds and Northrop. This instrument projects a laser beam through a stream of moving particles and measures the angles and intensities of light rays that result as the beam is deflected by the suspended particles. For our purposes, this particle size data will be referred to as Microtrac data.

As is confirmed by the comparison of the data in Table 2 and Table 3, these methods of measuring particle size and particle size distribution yield different results since the coal grind and coal type used to generate the data in both Table 2 and Table 3 was identically the same.

TABLE 1

VOLUME (MASS) DISTRIBUTION FROM DISPLAY AREA: 4

TABLE 1-continued

Indices
VOLUME MODE = 17.07 Median = 16.35 Microns and Larger
GEOMETRIC VOLUME MEAN = 15.14 +/− 17.82 (117.67%)
Skewness = −.11
ARITHMETIC VOLUME MEAN = 19.46 +/− 13.33 (68.48%)
Skewness = .18

For Plotting Probability on Log Paper:

| VOLUME PERCENTILE | PARTICLE SIZE: MICRONS AND LARGER |
|---|---|
| 00.1% | 77.78 |
| 01.0% | 62.63 |
| 06.0% | 44.29 |
| 22.0% | 26.33 |
| 50.0% | 16.35 |
| 78.0% | 9.72 |
| 94.0% | 4.27 |
| 99.0% | 1.16 |
| 99.9% | .61 |

TABLE 2

Particle Size by Microtrac

| CPFT | Particle Size Microns and Smaller |
|---|---|
| 100 | <300μ |
| 100 | 212 |
| 96.8 | 150 |
| 83.9 | 106 |
| 74.7 | 75 |
| 63.3 | 53 |
| 51.6 | 38 |
| 43.0 | 27 |
| 34.1 | 19 |
| 25.0 | 13 |
| 19.0 | 9.4 |
| 13.2 | 6.6 |
| 8.8 | 4.7 |

PH 124 where PH gives the 90th percentile in microns;
PM 34.9 is the 50th percentile in microns;
PS 5.11 is the 10th percentile in microns.

TABLE 3

| Volume Percentile | Particle Size Microns and Smaller |
|---|---|
| 99.9 | 140.9μ |
| 99 | 127.61 |
| 94 | 104.68 |
| 78 | 77.78 |
| 50 | 52.34 |
| 22 | 28.89 |
| 6 | 13.08 |
| 1 | 3.80 |
| 0.1 | 1.22 |

The preparation of the coal slurries and the incorporation therein of the surfactant used in the practice of the present invention may be accomplished by any of the techniques described in U.S. Pat. No. 4,282,006. Such grinding and milling techniques are well known and need not be described in detail herein. U.S. Pat. No. 4,282,006 is incorporated herein by reference.

Evaluation of the Invention

A Pittsburgh No. 8 coal was ball milled to have a particle size distribution falling within the Alfred formula. The solids content was greater than 57%.

To show the advantages of the invention, the following are presented in Table 4.

TABLE 4

| Additive (0.66%) | Lomar-D Standard Brookfield Viscosity cps at 60 rpm | Viscosity, cps With Additive | Percent Reduction |
|---|---|---|---|
| Copolymer A | 1250 | 225 | 82 |
| Copolymer B | 2320 (pH 3.75) | 1100 (pH 4.75) | 52 |

Having thus described our invention, it is claimed as follows:

1. An improved coal-water slurry of the type comprising at least 45% by weight of finely divided coal particles and a dispersing agent, said slurry being characterized as having a Brookfield viscosity at 60 rpm of less than 4,000 centipoise, the improvement which comprises adjusting the pH of said slurry to at least 6 and using as the dispersing agent, a water-soluble salt of an olefin/maleic acid copolymer having a molecular weight within the range of about between 3,000–50,000.

2. The improved coal-water slurry of claim 1 where the pH is at least 7.

3. The improved coal-water slurry of claim 1 where the copolymer is a water-soluble salt of a pentene/-maleic acid copolymer having a molecular weight of about 6,000.

4. The improved coal-water slurry of claim 1 where the copolymer is a water-soluble salt of a diisobutylene/maleic acid copolymer having a molecular weight of about 14,000.

* * * * *

UNITED STATES PATENT AND TRADEMARK OFFICE

CERTIFICATE OF CORRECTION

PATENT NO. : 4,441,888

DATED : April 10, 1984

INVENTOR(S) : Joseph Matt et al.

It is certified that error appears in the above-identified patent and that said Letters Patent is hereby corrected as shown below:

The title page should appear as shown on the per attached sheet.

Signed and Sealed this

*Eighteenth* Day of *September 1984*

[SEAL]

*Attest:*

GERALD J. MOSSINGHOFF

*Attesting Officer* *Commissioner of Patents and Trademarks*

United States Patent [19]

Matt et al.

[11] 4,441,888

[45] Apr. 10, 1984

[54] COAL-WATER SLURRY VISCOSITY REDUCTION USING OLEFIN/MALEIC ACID SALT COPOLYMERS

[75] Inventors: Joseph Matt, Downers Grove; John M. Ferrara, Palos Heights, both of Ill.

[73] Assignee: Nalco Chemical Company, Oak Brook, Ill.

[21] Appl. No.: 380,488

[22] Filed: May 21, 1982

[51] Int. Cl.[3] ..... C10L 1/32

[52] U.S. Cl. ..... 44/51; 44/62; 252/356

[58] Field of Search ..... 44/51, 62; 252/356

[56] References Cited

U.S. PATENT DOCUMENTS

| | | | |
|---|---|---|---|
| 2,615,845 | 10/1952 | Lippincott et al. | 44/62 |
| 4,242,098 | 12/1980 | Braun et al. | 44/62 |
| 4,282,006 | 8/1981 | Funk | 44/51 |
| 4,302,212 | 11/1981 | Yamamura | 44/51 |

FOREIGN PATENT DOCUMENTS

| | | | |
|---|---|---|---|
| 55-56189 | 4/1980 | Japan | 44/51 |
| 56-57891 | 5/1981 | Japan | 44/62 |

OTHER PUBLICATIONS

Steffers et al., Chemical Abstracts, vol. 91, No. 91:108877j, 1979.

*Primary Examiner*—Charles F. Warren
*Assistant Examiner*—Margaret B. Medley
*Attorney, Agent, or Firm*—John G. Premo; Robert A. Miller; Donald G. Epple

[57] ABSTRACT

An improved coal-water slurry of the type comprising at least 45% by weight of finely divided coal particles and a dispersing agent, said slurry being characterized as having a Brookfield viscosity at 60 rpm of less than 4,000 centipoise, the improvement which comprises adjusting the pH of said slurry to at least 6 and using as the dispersing agent, a water-soluble salt of an olefin/-maleic acid copolymer having a molecular weight within the range of about between 3,000-50,000.

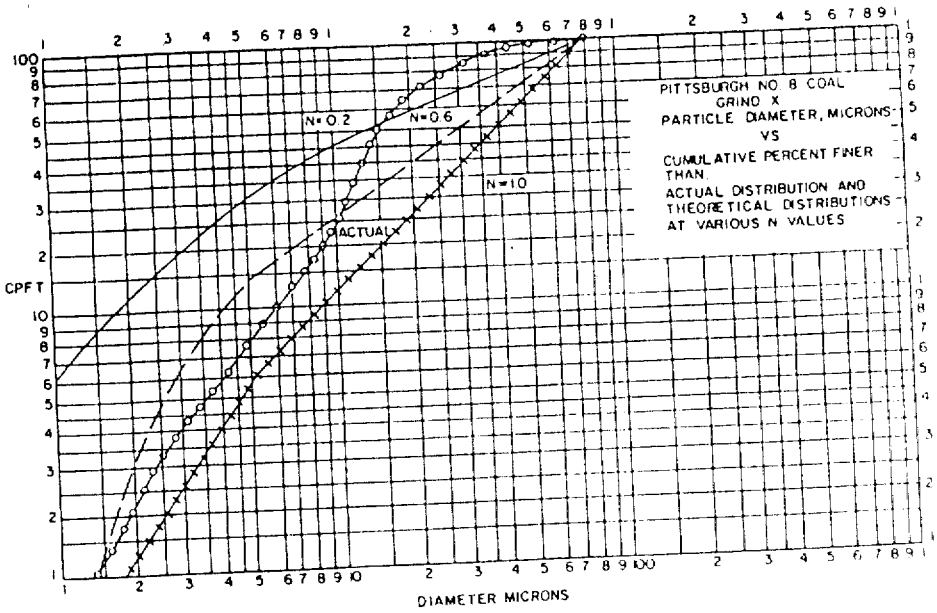

4 Claims, 2 Drawing Figures